US007442409B2

(12) United States Patent
Bender et al.

(10) Patent No.: US 7,442,409 B2
(45) Date of Patent: Oct. 28, 2008

(54) DIFFERENTIAL PROCESSING OF POWDER COATED SUBSTRATES

(75) Inventors: Todd M. Bender, Auburn, PA (US); Paul R. Horinka, Reading, PA (US); Joseph J. Kozlowski, Reading, PA (US); Gregory R. Mill, Womelsdorf, PA (US); John R. Petro, Fleetwood, PA (US); Grant E. Schlegel, Macungie, PA (US); Carryll A. Seelig, Reading, PA (US); Gordon L. Tullos, Reading, PA (US)

(73) Assignee: Rohm and Haas Company, Philadelphia, PA (US)

( * ) Notice: Subject to any disclaimer, the term of this patent is extended or adjusted under 35 U.S.C. 154(b) by 1294 days.

(21) Appl. No.: 10/121,105

(22) Filed: Apr. 11, 2002

(65) Prior Publication Data

US 2002/0176941 A1 Nov. 28, 2002

Related U.S. Application Data

(60) Provisional application No. 60/284,539, filed on Apr. 18, 2001.

(51) Int. Cl.
*B05D 1/06* (2006.01)

(52) U.S. Cl. ..... 427/195; 427/325; 427/485

(58) Field of Classification Search ..... 427/471, 427/475, 477, 485, 195, 393, 291, 325, 444
See application file for complete search history.

(56) References Cited

U.S. PATENT DOCUMENTS

| | | | | |
|---|---|---|---|---|
| 5,344,672 | A | 9/1994 | Smith | 427/195 |
| 5,721,052 | A | 2/1998 | Muthiah et al. | 428/413 |
| 5,824,373 | A * | 10/1998 | Biller et al. | |
| 6,136,370 | A * | 10/2000 | Muthiah et al. | |
| 6,436,485 | B1 | 8/2002 | Sedlmeyr | 427/521 |

FOREIGN PATENT DOCUMENTS

| | | | |
|---|---|---|---|
| DE | 19533858 | A1 | 7/1997 |
| EP | 0933140 | A1 | 8/1999 |
| EP | 1062053 | B1 | 12/2000 |

OTHER PUBLICATIONS www.mistupid.com/homeimpr/sandpaper.htm 2001-2004.*
www2.ncsu.edu/wantrp Oct. 2003.*
TIVAR website, Poly Hi Solider Inc 2001.*
WPI World Patent Index; XP002104528, JP 75-0025077, Mar. 3, 1975.

* cited by examiner

*Primary Examiner*—Frederick J Parker
(74) *Attorney, Agent, or Firm*—Andrew E. C. Merriam

(57) ABSTRACT

A method of providing a powder coating to MDF substrate panels wherein, by the differential treatment of the front and back surfaces of these panels, both surfaces can be coated at the same time and the effects of moisture and other volatile outgassing is controlled in such a way as to provide a blemish-free front facing surface with a minimal, but nonetheless acceptable, amount of blemishes on the opposite or back surface. Differential treatment is achieved by preparing each surface using different grades of sand-paper, applying different amounts of curing energy, whether infra-red or thermal, or by applying different thicknesses of coating to each surface.

2 Claims, No Drawings

DIFFERENTIAL PROCESSING OF POWDER COATED SUBSTRATES

CROSS REFERENCE TO RELATED PATENT APPLICATIONS

This is a non-provisional application of prior pending U.S. provisional application Ser. No. 60/284,539 filed Apr. 18, 2001.

FIELD OF THE INVENTION

This invention is directed to the process of applying powder coatings to various substrates, particularly to heat-sensitive substrates such as wood and fiberboard materials. These substrates are fabricated or machined generally into the shapes of panels, doors and cabinet or table tops which are used in the furniture manufacturing industry. In particular, the invention is directed to reducing the formation of blisters or other surface blemishes which often result from the application of surface finishes to the target substrate. These problems are especially prevalent with the application of powder coatings to the substrate surfaces.

BACKGROUND OF THE INVENTION

Powder coatings are dry, fine particles which are solid at room temperature and which, over recent years, have gained considerable acceptance over liquid coatings as surface finishes for a number of different types of substrates. Powder coatings are more environmentally friendly than liquid coatings because they are virtually free of harmful fugitive organic solvent carriers that are customarily present in liquid based coatings. This reduces or altogether eliminates solvent emission problems associated with air pollution and health risks experienced by the workers employed in either preparing or applying the coating material.

Early uses of powder coatings involved application onto metal substrates. Since these substrates can withstand the high temperatures that were required to fuse and cure these first generation powder coatings, application was limited to these types of substrates. However, the technology has evolved to the point where powder coatings are now being employed to coat heat sensitive materials, such as wood, fiberboard and plastics which, due to the sensitive nature of the substrates, require that the powder coating be capable of fusing (as in the case of thermoplastic coatings) or fusing and curing (as in the case of thermoset coatings) at comparatively low temperatures. Low temperature curable coatings reduce or altogether eliminate charring or warping of the substrate.

A common issue which must be addressed when coating wood or fiberboard is that of moisture escaping from the substrate during the fusing/curing cycle(s). This is referred to as "outgassing". These substrates contain entrapped moisture, typically between about 3 and about 10 percent by weight. This moisture is not altogether undesirable, however. Moisture is helpful as an element in the electrostatic application of coating powder in that it enables the otherwise non-conductive cellulosic material to hold sufficient electrical charge for the efficient electrostatic application of powder coatings. However, uncontrolled outgassing from the substrate when heat is applied during the fusing and/or curing cycles must be addressed.

In a wood substrate of generally uniform density, outgassing is usually evenly distributed throughout the entire surface of the coated object. However, in medium to high density fiberboard, different regions of the board material will inherently have different densities which will contain different levels of entrapped moisture. Medium density fiberboard (MDF), which is most often used to manufacture doors and panels for office furniture and kitchen cabinets, is a very porous substrate which contains water and other volatiles.

During the process of applying a powder coating to MDF substrates, it is customary to preheat the substrate prior to powder application in order to release some of the entrapped moisture and to aid in the application of the powder coating to the target surface. However, this step provides inconsistent results since moisture content can vary significantly due to variations in the manufacture of the board, storage conditions and coating application techniques. After the application of the powder coating surface finish, these moisture content variations will result in surface blisters, pinholes or inconsistent surface appearance spots, often called "dry spots".

Certain types of powder coatings may experience an increased number of problems related to surface blemishes. For example, the LAMINEER® coatings sold by the Morton Powder Coatings subsidiary of the Rohm and Haas Company seem particularly susceptible to outgassing related problems. Some solutions have been attempted, such as by increasing the pre-heat temperatures. While this process modification tends to reduce blistering, it is an incomplete fix for the appearance of dry spots. Further, if pre-heat temperatures are increased too high or the pre-heat cycle is maintained for too long a period of time, the MDF substrate will lose so much moisture that the electrostatic charge necessary for the application of powder coatings will be all but eliminated, thus inhibiting the successful application of a uniform powder coating finish.

MDF is manufactured by the digestion and milling of cellulosic materials which are provided by wood, sawdust, certain grasses and even cereal grain byproducts. Resins are then added as binders and the blended composition is then formed into a mat and compressed into sheets by either continuous line or multi-opening presses in the presence of heat to cure the binder. This process produces MDF boards which inherently possess a density gradient through its cross section. "Typical" MDF boards exhibit a density that is higher at its surface than at its core. Density may also vary from one surface to the other, opposite surface. These density variances will result in differences in the rate and amount of outgassing for each lot of board material.

One approach to eliminating outgassing defects and enabling the production of a uniform surface finish is disclosed in U.S. Pat. No. 6,136,370. This patent discloses the process of providing grooves or holes of various depths in the "back" or non-cosmetic side of the MDF panels, a process referred to as "back-routing". This process works very well with MDF parts where the back side is hidden from view and the grooves or holes are never visible in the final, assembled part. The problem with this approach, however, is that where both sides of a panel are visible either all the time or at various times during the operating of the piece of furniture or cabinet of which the MDF panel is a part, both surfaces must be as aesthetically pleasing as possible. This precludes the employment of the technique of the '370 patent. An example of such types of panels are what are referred to as "Flipper Doors" used in overhead office storage cabinets.

The present invention addresses the need to control the outgassing of moisture and other volatiles from within MDF substrates during the application of powder coatings. This is achieved by methods which will provide an aesthetically blemish-free front appearance surface with a minimum of blemishes on the opposing or back appearance surface of MDF panels. These methods will now be described in detail.

It is known that, with the equal application of heat to both surfaces of MDF, moisture and other volatiles will tend to escape, or outgas, out the less dense surface first. If both sides are coated with equal thicknesses of powder coating and heated evenly, outgassing will occur more on the less dense surface, leaving pin-holes, dry spots and other blemishes. The more dense surface will exhibit a relatively blemish free finish.

SUMMARY OF THE INVENTION

It is an object of this invention to manipulate the process of applying powder coatings to MDF boards in such a way as to control the rate and direction of outgassing. This is what we refer to as differential processing. By controlling the rate and direction of outgassing from each board being powder coated, we can create furniture or kitchen cabinet panels which have a consistent, blemish-free primary exposure front surface and a back, or infrequently exposed, surface which exhibits only minimal blemishes from the effects of outgassing.

In one aspect of the invention, a differential is created between the front and back surfaces by applying a thicker layer of powder coating to the front surface than to the back. The coated panel is then uniformly heated to fuse, as in the case of themoplastic coatings, or fuse and cure, as in the case of thermoset coatings, the applied powder coating. By applying a thicker coating to the front surface, the volatiles will be driven out of the back surface. The thickness of the coating is defined in relative terms because it is the disparity, or differential, which permits the applicator to control the effects of outgassing to provide the desired outcome. The front surface will then exhibit a blemish free finish with the back surface showing a permissible amount of pin-holes and/or dry spots.

In another aspect of the invention, control of outgassing is achieved by the differential sanding of the opposing surfaces of MDF panel. It has been discovered that by fine sanding the front surface while coarse sanding the back surface the volatiles are driven out the back surface. After the powder coating is applied, whether in different thicknesses, front versus back, or in a uniform thickness, the panel is heated to fuse or fuse/cure the coating. This differential processing results in a front surface which is uniformly blemish free, while the back surface will have some pin-holes and dry spots, as anticipated.

In yet another aspect of the invention, differential processing is achieved by varying the amount of energy applied to the front and back surfaces to fuse or fuse and cure the powder coating applied to these surfaces. Whether thermal or ultraviolet energy is the source of energy applied to cure the powder coating, it's application can be varied, in one instance by providing more energy to the front surface than to the back surface. This would permit the powder coating on the front surface to fuse or cure prior to the powder coating which has been applied to the back surface. The coating on the front surface will then have sealed up before the coating on the back surface. The volatiles will then be driven from the front surface to the back surface, thus resulting in a relatively blemish free front surface as compared to the back surface. A variation on this concept is to apply energy sooner to the front surface than to the back surface, thus permitting the coating on the front surface to cure prior to the coating on the back surface. Again, the internal volatiles will be driven from the front surface toward the back surface.

DETAILED DESCRIPTION OF THE INVENTION

The various aspects of the invention show how the differential treatment of the powder coating application process can control the surface appearance of the finish coating. These steps may be practiced individually or in various combination(s) with each other. For example, it may be found that for a specific type of MDF panel the combination of differential sanding and differential coating thicknesses provides the optimum control over the appearance of the finish coating. For another type of MDF panel, perhaps for a different end-use application, it may be that the combination of differential sanding, differential coating thicknesses and differential energy treatment is necessary to achieve acceptable front and back surface coating finishes.

The following examples will demonstrate the effectiveness of the practice of the present invention. Various MDF panels were tested in accordance with the invention.

All testing was performed with the same time/temperature cycle: The panels were preheated for 15 minutes in an oven having a 375° F. temperature. The panels were then coated when the board surface temperature was at 200° F. The panels were then subjected to 375° F. again for a period of 5 minutes to effect a cure. Samples 1-4 were 12 inch by 12 inch by 1 inch thick MDF. Samples 5 and 6 were 1 inch thick oval MDF pieces.

| SAMPLE # | PREPARATION | RESULT |
|---|---|---|
| 1 | both sides sanded the same both sides coated at 6-8 mils | Many face outgassing spots on front and back |
| 2 | Front side only sanded both sides coated at 6-8 mils | Less outgassing on front than back |
| 3 | Both sides sanded; front coated at 6-8 mils/back at 3-4 mils | Pinholes and outgassing-back only; front looked good |
| 4 | Front only sanded; front coated at 6-8 mils/back 3-4 | Front looked good; pinholes and outgassing on back only |
| 5 | Both sides sanded Both sides coated at 6-8 mils | Outgassing blemishes on both sides |
| 6 | Front only sanded; front coated at 6-8 mils/back at 3-4 mils | Front looked good; pinholes and outgassing on back only |

Samples 1-4 show that by applying a thinner coating to the back side of the panels provided a route of escape for the entrapped gasses. The back surfaces thus exhibited a greater number of imperfections caused by outgassing than did the front surface. Samples 5-6 confirmed that a thinner coating on the back surfaces of the panels results in a more uniform, aesthetically pleasing finish on the front surface.

We claim:

1. On an MDF substrate having a front appearance surface and a back appearance surface, a method for forming a continuous coating on said substrate wherein the front appearance surface is free of and the back appearance surface exhibits surface blemishes caused by the outgassing of moisture and other volatiles from said substrate comprising pre-heating said substrate, applying a film of powder coating to the front appearance surface, applying a film of powder coating to the back appearance surface, wherein the said coating on the back appearance surface is thinner than the said coating on the front appearance surface and heating the coating covered substrate to fuse or fuse and cure the powder coating.

2. On an MDF substrate having a front appearance surface and a back appearance surface, a method for forming a continuous coating on said substrate wherein the front appearance surface is free of and the back appearance surface exhibits surface blemishes caused by the outgassing of moisture and other volatiles from said substrate comprising any one of the methods of claims 1.

* * * * *